US005507914A

United States Patent [19]

Sarkar et al.

[11] Patent Number: 5,507,914

[45] Date of Patent: Apr. 16, 1996

[54] PROCESS FOR ENHANCING THE FREENESS OF PAPERMAKING PULP

[75] Inventors: Jawed M. Sarkar, Naperville; Hanuman P. Didwania, Lisle, both of Ill.

[73] Assignee: Nalco Chemical Company, Naperville, Ill.

[21] Appl. No.: 484,112

[22] Filed: Jun. 7, 1995

Related U.S. Application Data

[63] Continuation-in-part of Ser. No. 289,451, Aug. 12, 1994.

[51] Int. Cl.[6] ..... D21H 21/10

[52] U.S. Cl. ..... 162/100; 162/158; 162/168.2; 162/168.3; 162/182; 162/183; 162/9

[58] Field of Search ..... 162/158, 9, 100, 162/168.2, 168.3, 164.6, 183, 182, 72 B

[56] References Cited

U.S. PATENT DOCUMENTS

| | | | |
|---|---|---|---|
| 3,406,089 | 10/1968 | Yerkes | 162/199 |
| 4,923,565 | 5/1990 | Fuentes | 162/72 B |
| 5,169,497 | 12/1992 | Sarkar | 162/72 B |
| 5,308,449 | 5/1994 | Fuentes | 162/72 B |

FOREIGN PATENT DOCUMENTS

| | | | |
|---|---|---|---|
| 451031 | 10/1991 | European Pat. Off. | 210/606 |
| 2633514 | 2/1978 | Germany | 210/606 |

OTHER PUBLICATIONS

Eriksson, "Swedish Developments in Biotechnology Related to the Pulp and Paper Industry", *TAPPI Journal*, vol. 68, No. 7 (Jul. '85) pp. 46–55.

*Primary Examiner*—Peter Chin

*Attorney, Agent, or Firm*—James J. Drake; Robert A. Miller

[57] ABSTRACT

A process for enhancing the freeness of paper pulp, which comprises the steps of adding to the pulp from about 0.5 to about 2.5 kilograms per ton based on the dry weight of the pulp, of a cellulolytic enzyme at the vertical tank of the papermaking process, allowing the pulp to contact the cellulolytic enzyme for from about 30 minutes to about 60 minutes, adding at least 0.011%, based on the dry weight of the pulp, of a water soluble cationic polymer, adding at least 0.007%, based on the dry weight of the pulp, of a water soluble anionic polymer and forming the thus treated pulp into paper.

5 Claims, 3 Drawing Sheets

PROCESS FOR ENHANCING THE FREENESS OF PAPERMAKING PULP

REFERENCE TO RELATED PATENT

The present application is a continuation-in-part of application Ser. No. 08/289,451, filed Aug. 12, 1994, by Jawed M. Sarkar and Hanuman P. Didwania, entitled "Enzymes in Combination with Polyelectrolytes for Enhancing the Freeness of Clarified Sludge in Papermaking", the disclosure of which is incorporated herein by reference.

BACKGROUND OF THE INVENTION

2. Field of the Invention

The invention relates to a method of applying a combination of cellulolytic enzymes with cationic and anionic polymers for use in enhancing the freeness of pulp a in papermaking process and, more particularly, a multiple feed point process for the use of the cellulolytic enzymes.

3. Description of the Prior Art

Use of cellulolytic enzymes, e.g. cellulases and/or the hemicellulases for treating recycled paper pulps to improve freeness is the subject of U.S. Pat. No. 4,923,565 the disclosure of which is incorporated herein by reference.

U.S. Pat. No. 5,169,497, issued to Sarkar and Cosper discusses the effects of cellulases in combination with cationic flocculants of varying composition on the freeness of old corrugated containers (OCC) pulp. The '497 patent covers the use of a combination of enzyme and cationic polymers for enhancing the freeness of recycled fiber. In practice, dual polymer treatment programs are also used for retention.

In a dual polymer retention system, two synthetic polymers are mixed with the pulp sequentially to achieve better results than obtained with either polymer by itself. These improved results are specifically aimed at increasing the retention of pulp fibers on the paper sheet. Increased retention results in a paper sheet having increased strength.

Usually, a low molecular weight, highly charged cationic polymer is added to the papermaking process first and, at a later stage, a high molecular weight, anionic polymer is added. Good retention has numerous economic benefits. As the use of recycled fiber increases in container board, fine paper, and newsprint grades, the opportunity to provide benefits through retention aids has also increased. If fines are not retained by a good retention aid or hydrolyzed by an enzyme, they will impede drainage, fill felts, and cause deposition problems. The key benefit of retention aids with enzyme is to prevent drainage reduction and subsequent loss of machine speed. Drainage can be maintained by preventing the build-up of fines in the white water loop.

U.S. Pat. No. 5,308,449, issued to Fuentes et al. discusses the use of enzymes as a method of treating recycled paper for use as a papermaking pulp. There is no discussion in Fuentes et al. of the use of treatment agents for enhancing the freeness and drainability of pulp once the recycled paper has been introduced back into the papermaking process.

Ideally, a method would exist which would increase the freeness of paper pulp while at the same time maintaining the strength necessary to produce a defect-free paper sheet.

SUMMARY OF THE INVENTION

A process for enhancing the freeness of paper pulp, which comprises the steps of adding to the pulp from about 0.5 to about 2.5 kilograms per ton based on the dry weight of the pulp, of a cellulolytic enzyme at the vertical tank of the papermaking process, allowing the pulp to contact the cellulolytic enzyme for from about 30 minutes to about 60 minutes, adding to the pulp from abut 0.1 to abut 0.5 kilograms per ton based on the dry weight of the pulp of a cellulolytic enzyme adding at least 0.011%, based on the dry weight of the pulp, of a water soluble cationic polymer, adding at least 0.007%, based on the dry weight of the pulp, of a water soluble anionic polymer and forming the thus treated pulp into paper.

DESCRIPTION OF THE PREFERRED EMBODIMENTS

Figure 1:
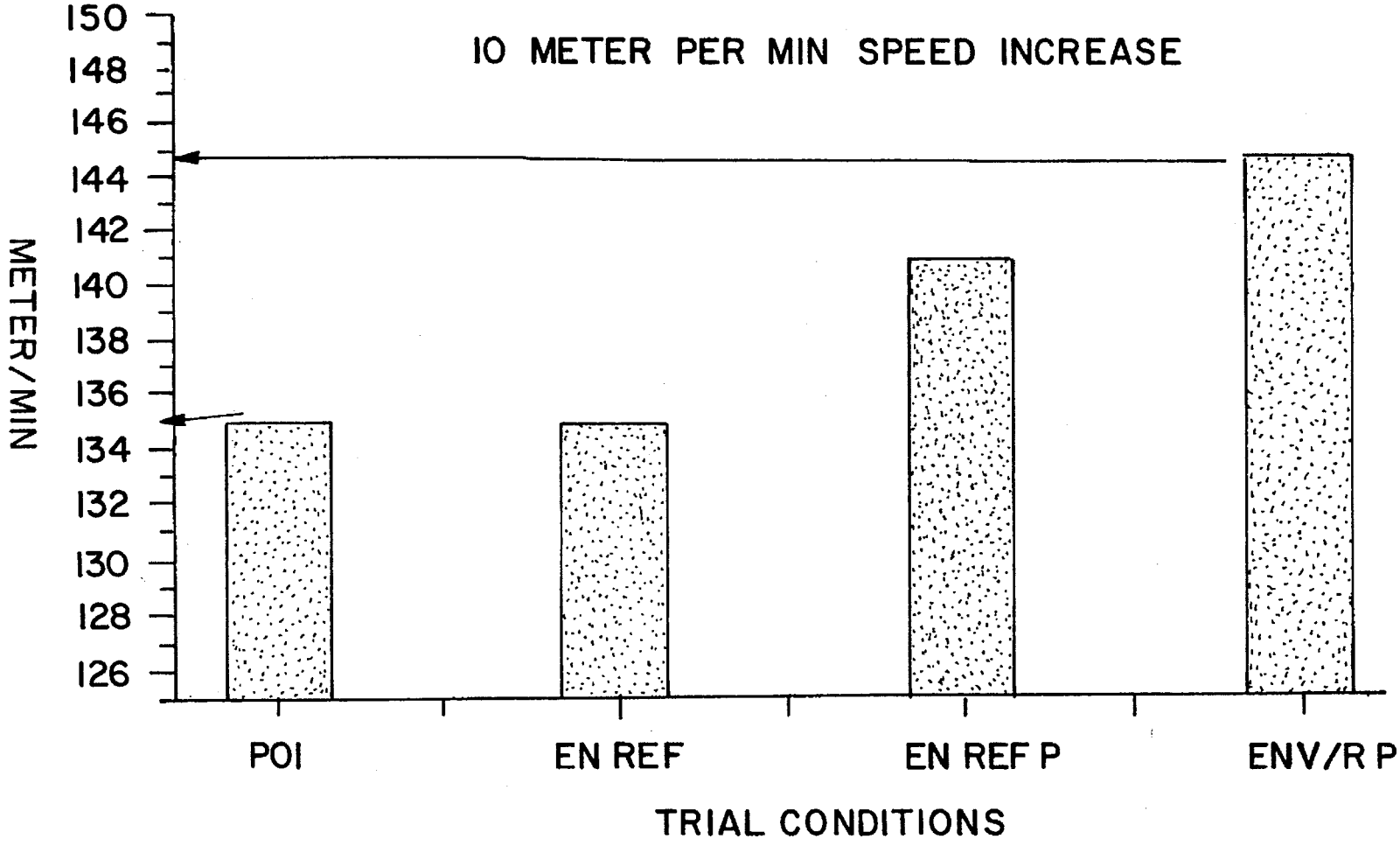
FIG. 1 is a graph showing the difference in machine speed for a paper machine utilizing different treatment methods.

A variety of water soluble cationic coagulants may be used in the practice of the invention. Both condensation and vinyl addition polymers may be employed. For a list of water soluble cationic polymers, reference may be had to Canadian patent 731,212, the disclosure of which is incorporated herein by reference. Included among these polymers are dimethylaminoethylacrylate benzyl chloride quaternary ammonium salts copolymerized with acrylamide, terpolymers of dimethylaminoethylacrylate methyl chloride quaternary ammonium salt, acrylamide and vinyl trimethoxysilane, diallyldimethyl ammonium chloride copolymerized with vinyl trimethoxysilane, copolymers of diallyldimethyl ammonium chloride and dimethylaminoethylacrylate benzyl chloride quaternary ammonium salt, polymeric n-vinylformamide, partially or completely hydrolyzed polymeric n-vinylformamide, copolymers of n-vinylformamide and vinylamine or its hydrochloric (HCL) salts, polyvinylamine or its HCL salts, partially or completely hydrolyzed polymeric n-vinylformamide methyl chloride quaternary ammonium salts, copolymers of n-vinylformamide and acrylamide, terpolymers of vinylamine, n-vinylformamide and acrylamide, copolymers of acrylamide and vinylamine, terpolymers of acrylamide, n-vinylformamide and vinylamine methyl chloride quaternary ammonium salts, copolymers of acrylamide and vinylamine methyl chloride quaternary ammonium salts, terpolymers of acrylamide, sodium acrylate and n-vinylformamide, terpolymers of acrylamide, sodium acrylate and vinylamine and its acid salts or quats, polymers of acrylamide, sodium acrylate, n-vinylformamide and vinylamine and its acid salts or quats, copolymers of n-vinylformamide and sodium acrylate, copolymers of diallyldimethyl ammonium chloride and n-vinylformamide, terpolymers of diallyldimethyl ammonium chloride, n-vinylformamide and vinylamine and its acid salts or quats, terpolymers of acrylamide, sodium acrylate and vinyl trimethoxysilane and terpolymers of diallyldimethyl ammonium chloride, acrylamide and vinyl trimethoxysilane.

A preferred group of cationic polymers are the cationic polymers of acrylamide which in a more preferred embodiment of the invention, contain from 40–89% by weight of acrylamide. Larger or smaller amounts of acrylamide in the polymers may be used, e.g., between 30–80%. Typical of the cationic monomers, polymerized with acrylamide are the monomers diallyldimethyl ammonium chloride, (DADMAC), dimethylaminoethyl/acrylate methyl chloride quaternary ammonium salt, (DMAEA. MCQ), epichlorohydrin dimethylamine condensate polymer (epi-DMA) and ethylene dichloride (EDC-$NH_3$). When these cationic acrylamide polymers are used they should have a RSV (reduced specific viscosity) of at least 3 and preferably the RSV should be within the range of 5–20 or more. RSV was determined using a one molar sodium nitrate solution at 30° C. The concentration of the acrylamide polymer in this solution is 0.045%.

A preferred group of anionic polymers are polymers of acrylamide containing 20–95% acrylamide and 5 to 80% anionic monomer by weight of the polymer such as acrylic acid or methacrylic acid.

The invention has utility in improving the drainage or the freeness of a wide variety of sludges and paper pulps including Kraft and other types of pulp such as mixed office waste. The invention is particularly useful in treating pulps that contain recycled fibers. The effectiveness of the invention in improving drainage is most notable when the pulps contain at least 10 percent by weight of recycled fiber, with great improvements being evidenced when the recycled fiber content or the pulp being treated is at least 50% or more.

As indicated, the invention requires that the pulp first be treated with an enzyme at two distinct and separate points in the papermaking process, then with a cationic polymer and, finally, with an anionic polymer. It is also important to the successful practice of the invention, that the conditions under which the treatment with the enzyme occurs is such to provide optimum reaction time of the enzyme of the pulp. Preferably, the enzyme is a cellulase or hemicellulase such as those disclosed in U.S. Pat. No. 4,923,565.

The treatment of the pulp with the enzyme is preferably conducted for a period of time not greater than 60 minutes. The minimum treating time is about 30 minutes. A typical treating time would be about 40 minutes. The pH of the pulp to achieve optimum results should be between the ranges of 5 to 7.5. The temperature of the treatment should not be below 20° C., and usually should not exceed 60° C. A typical average reaction temperature is favorably conducted is 40° C.

The preferred dosage of the cationic polymer, as actives, is from 0.025% to 0.02% polymer based on the dry weight of the pulp. A general dosage which may be used to treat the pulp with the polymer is from 0.01% to 0.08% by weight of the polymer. The preferred dosage of anionic polymer, as actives, is 0.025%–0.075% polymer based on the dry weight of the pulp.

In order for the enzyme to have sufficient reaction time and mixing described above, it is necessary that they be added to the pulp at the point in the paper making system to allow sufficient time for the above conditions to occur. The residence time for the enzyme added at the vertical tank or any chest prior to the refiner is preferably from about 30 to about 60 minutes. This is a sufficient reaction time to utilize all the enzyme added. Full consumption of the enzyme after the pulp has been refined is ensured by adding the enzyme before the refiner.

It has been found that the use of multiple feed points for the polymer and enzyme conveys an unexpected advantage. Improved performance is achieved when the enzyme dosage is "split". By splitting dosages, improvements in both strength and speed of the paper machine are achieved. By contrast, treatment of the pulp with enzyme at one point such as in a chest only may increase machine runability but decrease paper strength.

In the preferred embodiment of the invention, a dosage of from about 0.5 to about 2.5 kg/ton of dry pulp a cellulolytic enzyme is added to the vertical tank of a paper machine before the pulp is sent through one or more refiners. Before refining, a dosage of from about 0.1 to 1.5 kg/ton of dry pulp of the enzyme is added prior to sending the pulp to the machine chest of the paper mill machine. In a preferred embodiment of the application, the enzyme comprises Pergalase-A40 available from Genencor International.

The following examples are presented to describe preferred embodiments and utilities of the invention and are not meant to limit the invention unless otherwise stated in the claims appended hereto.

EXAMPLE 1

A trial to evaluate a cellulolytic enzyme, Pergalase-A40, on pulp freeness in a continuous system at a North American recycle mill was carried out. Five trials were run at the recycle paper mill. The mill has a capacity of 50 tons/day. Under operational conditions, 0.5 kg/t of enzyme was added before the refiners and 1.5 kg/t enzyme was added to the vertical tank (residence time 60 minutes). The following results were achieved.

9% increase in CMT (Corrugated Medium Test)

4% increase in CFC (Corrugated Fluted Crush)

13% increase in machine speed

10% increase in production

Final product specs were achieved with a lower grammage paper

EXAMPLE 2

100% recycled local recycled Kraft pulp was treated with Pergalase-A40 at a dose of 3 kg/ton dry pulp. Pergalase-A40 was fed continuously for a period of eight hours. The residence time in the vertical chest was 120 minutes.

Pulp was treated with Pergalase-A40 (3 kg/ton dry pulp) in the machine chest. The residence time in machine chest was 20 minutes.

CONCLUSIONS:

The freeness of pulp was increased by 70 ml. A small residence time is responsible for relatively small increase in freeness.

The dry line moved 30 cm towards the headbox.

Strength parameters such as Ring Crush and CFC remained stable while CMT decreased by 10%

EXAMPLE 3

The pulp in a vertical tank was treated with Pergalase-A40 (1.5 kg/ton dry pulp). The residence time was 60 minutes. Pulp was also treated in the pipe line with enzyme at a dose of 1.5 kg/ton dry pulp.

CONCLUSIONS:

The freeness of pulp was increased by 60 ml. The dry line moved by 100 cm towards the headbox.

Machine speed increased by 10% with a 4.5% increase in production.

There was some improvement in the loss of CMT but was below the mill specifications.

The challenge during the trials was to prevent the reduction in CMT occurring during the enzyme treatment. An experiment was carried out where the pulp was refined by the main refiner to different levels with and without enzyme.

It was found that at all the levels of refining the freeness values decreased when the pulp was refined in the presence of enzyme compared to the refining carried out without enzyme. When the pulp treated with enzyme was stored at ambient temperature the freeness increased and exceeded the values of freeness obtained with pulp refined in the absence of enzyme. This experiment showed that if a small dose of enzyme is added before the refiners it may fibrillate the pulp that is transferred to the machine chest. The residence time in the machine chest is 20 minutes. This may help in further increasing the freeness. Two more trials were carried out where enzyme was also added to pulp before refiners and in the machine chest.

EXAMPLE 4

The pulp in the vertical tank was treated with Pergalase-A40 (1.5 kg/ton dry pulp). The residence time was 60 minutes; 0.5 kg/ton dry pulp of enzyme was also added to the machine chest.

CONCLUSIONS:

Production increased by 10%.

An improvement of 10% in CMT. CFC increased by 4%.

Specifications achieved at low grammage indicates that using less fiber (lower basis weight) a higher quality paper can be produced.

Production increased by 10%.

As can be seen, the Pergalase-A40 enhances the freeness of recycled pulp and probably improves the fibrillation which is extremely important in maintaining the strength of the paper.

EXAMPLE 5

A trial was run on a paper machine under the following trial conditions:

Baseline: polymer/no polymer (POI)

2 kg/ton enzyme added to the inlet of refiner (no polymer) (EN REF)

2 Dg/ton enzyme added to the inlet of refiner (polymer) (EN REF P)

1 Kg/ton to the vertical tank and 0.5 Kg/t at the refiner inlet (EN V/R P)

The current trial was run on the liner grade SK-17: furnish:

| | |
|---|---|
| LOCAL KRAFT | 30% |
| US OCC | 30% |
| CORRC CLIPPINGS | 30% |
| RECYCLE BROKE | 10% |

FIG. 1 shows that there is an increase in machine speed by 10 meters per minute when split addition of enzyme is resorted (Trial condition 4). The speed increase is 7.5% over the baseline.

Figure 2:
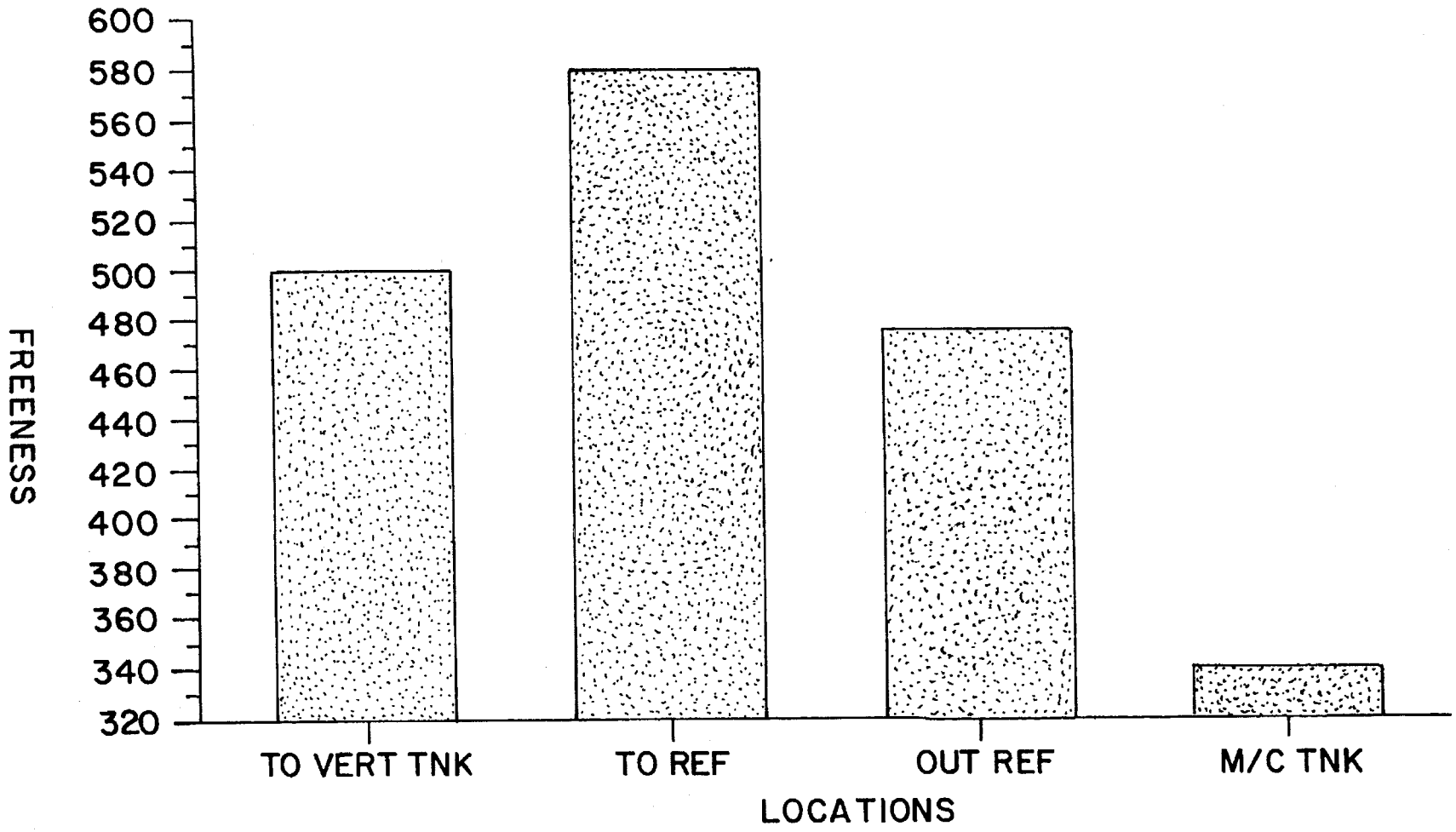
FIG. 2 is a graph showing differences in freeness utilizing a split enzyme treatment.
Figure 3:
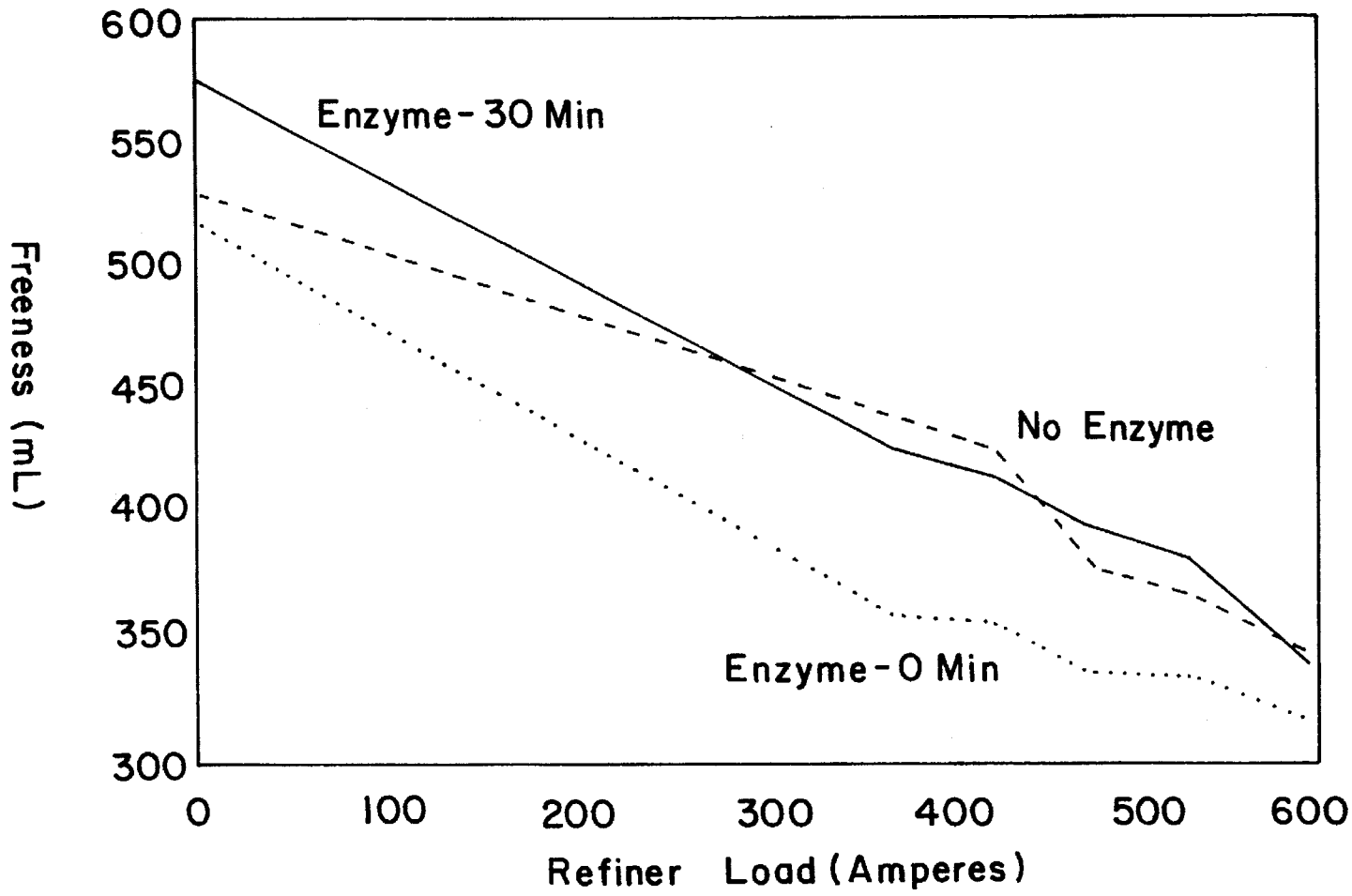
FIG. 3 comprises a graph comparing the effects of enzyme added to a paper mill pulp at various residence times to pulp not treated with enzyme.

FIG. 2 shows the freeness at various locations in the system under the split addition of enzyme (Trial condition 4). The vertical tank exit freeness went up by about 80 ml due to enzyme addition. The refiner with additional 0.5 Kg/t enzyme at the inlet lowered the freeness by 120 ml CSF. Without enzyme being added to the refiner (baseline), for the same refiner load, the freeness drop was only 60 ml CSF.

We claim:

1. A process for enhancing the freeness of pulp in a paper mill machine, the paper machine including a vertical tank, one or more refiners and a machine chest and wherein the pulp flows from the paper machine vertical tank through the refiners and into the machine chest, which comprises the sequential steps of:

a) adding to the pulp from about 0.5 to about 2.5 kilograms per ton based on the dry weight of the pulp, of a cellulolytic enzyme at the vertical tank;

b) allowing the pulp to contact the cellulolytic enzyme for from about 30 minutes to about 60 minutes;

c) adding to the pulp 0.1 to 0.5 kilogram per ton based on dry weight of the pulp of a cellulolytic enzyme before a refiner wherein the pulp is refined, d) adding at least 0.011% based on the dry weight of the pulp of a water-soluble cationic polymeric coagulant at the machine chest; and e) adding at least 0.007% based on the dry weight of the pulp of a water soluble anionic polymer selected from the group consisting of acrylamide/acrylic acid and acrylamide/methacrylic acid polymers.

2. The process of claim 1, wherein the water soluble cationic polymer is a copolymer which contains from 20% to 80% by weight of acrylamide.

3. The process of claim 2, wherein the cationic acrylamide copolymer is an acrylamide-diallyldimethyl ammonium chloride copolymer.

4. The process of claim 1, wherein the anionic acrylamide polymer has from about 20 to 95% acrylamide and from about 5 to 80% anionic monomer selected from the group consisting of acrylic acid and methacrylic acid by weight of the polymer.

5. The process of claim 1, wherein the cationic polymers are selected from the group consisting of: dimethylaminoethylacrylate benzyl chloride quaternary ammonium salts copolymerized with acrylamide, terpolymers of dimethylaminoethylacrylate methyl chloride quaternary ammonium salts, acrylamide and vinyl trimethoxysilane, diallyldimethyl ammonium chloride copolymerized with vinyl trimethoxysilane, copolymers of diallyldimethyl ammonium chloride and dimethylaminoethylacrylate benzyl chloride quaternary ammonium salt, polymeric n-vinylformamide, partially or completely hydrolyzed polymeric n-vinylformamide, copolymers of n-vinylformamide and vinylamine or its hydrochloric salts, polyvinylamine or its hydrochloric salts, partially or completely hydrolyzed polymeric n-vinylformamide methyl chloride quaternary ammonium salts, copolymers of n-vinylformamide and acrylamide, terpolymers of vinylamine, n-vinylformamide and acrylamide, copolymers of acrylamide and vinylamine, terpolymers of acrylamide, n-vinylformamide and vinylamine methyl chloride quaternary ammonium salts, copolymers of acrylamide and vinylamine methyl chloride quaternary ammonium salts, terpolymers of acrylamide, sodium acrylate and n-vinylformamide, terpolymers of acrylamide, sodium acrylate and vinylamine and its acid salts or quats, polymers of acrylamide, sodium acrylate, n-vinylformamide and vinylamine and its acid salts or quats, copolymers of n-vinylformamide and sodium acrylate, copolymers of diallyldimethyl ammonium chloride and n-vinylformamide, terpolymers of diallyldimethyl ammonium chloride, n-vinylformamide and vinylamine and its acid salts or quats, terpolymers of acrylamide, sodium acrylate and vinyl trimethoxysilane and terpolymers of diallyldimethyl ammonium chloride, acrylamide and vinyl trimethoxysilane.

* * * * *